US006666647B1

(12) United States Patent
Trask

(10) Patent No.: US 6,666,647 B1
(45) Date of Patent: Dec. 23, 2003

(54) NECK FAN FOR PERSONAL COOLING

(76) Inventor: Russell B. Trask, 18 Newtown La., Melville, NY (US) 11747

( * ) Notice: Subject to any disclaimer, the term of this patent is extended or adjusted under 35 U.S.C. 154(b) by 0 days.

(21) Appl. No.: 10/055,530

(22) Filed: Jan. 22, 2002

Related U.S. Application Data

(60) Provisional application No. 60/306,919, filed on Jul. 20, 2001.

(51) Int. Cl.[7] ..... F04D 29/54

(52) U.S. Cl. ..... 415/211.2; 416/63; 416/146 R; 416/246; 416/247 R; 62/259.3; 454/370; 417/234; 417/411; 224/258

(58) Field of Search ..... 416/63, 146 R, 416/244 R, 246, 247 R; 415/206, 211.2; 62/259.3; 454/370; 224/257, 258; 417/234, 411, 423.14

(56) References Cited

U.S. PATENT DOCUMENTS

| | | | | | |
|---|---|---|---|---|---|
| 2,356,209 | A | * | 8/1944 | Brilhart | 224/258 |
| 2,572,889 | A | * | 10/1951 | Strykower | 224/258 |
| 3,096,702 | A | * | 7/1963 | Malone, Sr. et al. | 454/370 |
| 3,168,748 | A | * | 2/1965 | Limberg | 416/146 R |
| 5,046,329 | A | * | 9/1991 | Travis, III | 62/259.3 |
| 5,146,765 | A | | 9/1992 | Waters | 62/259.3 |
| 5,178,311 | A | * | 1/1993 | McBride | 224/257 |
| 5,244,135 | A | * | 9/1993 | Nelson | 224/257 |
| 5,304,035 | A | | 4/1994 | Carter | 416/63 |
| 5,307,966 | A | * | 5/1994 | Inaba et al. | 224/258 |
| 5,379,928 | A | * | 1/1995 | Mikkelsen | 224/257 |
| 5,474,427 | A | * | 12/1995 | Redetzke | 416/247 R |
| 6,135,714 | A | | 10/2000 | Hsu | 416/63 |
| 6,155,782 | A | * | 12/2000 | Hsu | 416/63 |
| 6,179,564 | B1 | | 1/2001 | Park | 416/63 |
| 6,192,702 | B1 | | 2/2001 | Shimogori | 62/259.3 |

FOREIGN PATENT DOCUMENTS

| | | | | |
|---|---|---|---|---|
| GB | 714607 | * | 9/1954 | 224/257 |

* cited by examiner

*Primary Examiner*—Christopher Verdier

(57) ABSTRACT

Provided is a neck fan for personal cooling which can be supported by a lanyard around a wearer's neck so that a cooling breeze may be directed to cool the wearer's face and neck area while the wearer's hands are free to be engaged in ordinary activities of work, leisure, play, —, —, etcetera. The geometry of the construction of the fan device is such that it lay close to the body of the wearer so as to minimize the fan device from coming into undesirable contact with other items in the wearer's environment. The lanyard which supports the fan device about the wearer's neck may be provisioned with an optional break-away safety link so that should the fan device become accidentally entangled with the environment, the breakaway safety link will permit the lanyard to separate before the wearer will be seriously injured. The lanyard system also provided length and angle adjustments.

8 Claims, 1 Drawing Sheet

NECK FAN FOR PERSONAL COOLING

CROSS REFERENCE TO RELATED APPLICATIONS

The instant application is a formal application of U.S. provisional application No. 60/306,919, filed on Jul. 20, 2001, and entitled NECK FAN FOR PERSONAL COOLING, and claims the benefit under 35 USC 119(e) of said U.S. provisional application.

BACKGROUND OF THE INVENTION

1. Field of the Invention

The present invention relates to small portable electrical fans and more particularly to a fan device which can be supported by a lanyard around a wearer's neck so that a cooling breeze may be directed, toward the neck and face area of the wearer, to cool the wearer.

2. Description of the Prior Art

Numerous innovations for neck fans for personal cooling having been provided in the prior art that will be described. Even though these innovations may be suitable for the specific individual purposes to which they address, however, they differ from the present invention.

A first example, U.S. Pat. No. 5,146,765 to Waters teaches an air conditioning unit for use in the cooling of persons includes a fan secured below the person's neck. A moistened foam necklace may be wrapped around the neck or a moistened foam pad otherwise positioned between the fan and the neck of the user. The fan of the air conditioning unit includes a frame, an electric motor mounted on the frame, a fan blade operably connected with the motor and rotatable by the motor for moving air, a battery or other power source operably connected with the motor for actuation thereof, and a switch operably connected between the battery or power source and the motor for controlling the actuation of the motor. Furthermore, the air conditioning unit includes a flexible element attached to the frame, the flexible element being constructed and arranged to be worn around the user's neck so that air generated by the moving fan blade moves against the neck area after being evaporatively cooled by the foam necklace or pad.

A second example, U.S. Pat. No. 5,304,035 to Carter teaches a portable fan worn in a self-oriented position on a wearer for directing a current of cooling air toward the wearer. The fan has a housing made of lightweight material, a lightweight electric motor in the housing powered by a source such as a battery so that the motor does not require physical connected to a fixed location remote from the wearer, a mechanism for moving air including a shaft connected to the motor, a hub on the shaft and a plurality of vanes projecting radially outwardly from the hub, the shaft, hub and vanes being made of a lightweight material, a shroud made of lightweight material connected to the housing and substantially enclosing said air moving mechanism, and a mechanism for supporting the fan below the wearer's face in an orientation wherein said air moving mechanism directs a current of air upwardly toward the wearer's face without being manually held.

A third example, U.S. Pat. No. 6,135,714 to Hau teaches a necklace hanger for mounting on a portable fan to be worn is disclosed. The hanger includes a main body having a ring for fitly mounting on a fan and an extension for supporting the shroud of the fan. Then a cord is connected to the extension to form a loop for hanging the fan to one's neck. The hanger can selectively be combined with the fan by the user and is suitable for applying to other portable fans. Furthermore, the connecting mechanism of the cord and the main body is in a detachable manner that when an outer force applied to the connectors exceeds a certain extent, the cord will be released from the hanger to prevent from harming the wearer.

A fourth example, U.S. Pat. No. 6,179,564 B1 to Park teaches a portable electric fan is provided. The portable electric fan includes a handle constructed of a case in the form of a hollow column, having one end through which one or more power supplying batteries are installed, a motor connected to the electrode of the battery for providing a rotational driving force, a fan which is installed on a rotating shaft of the motor and is rotatably driven, a protecting member enclosing the fan rotated by the motor, and a cord attached to some part of the protecting member. Therefore, the portable electric fan can be operated, while hanging around some part of a user's body such as the neck. Accordingly, it is possible to freely use both hands. Also, it is possible to safely produce air movement since a protecting member enclosing the fan is formed. Also, holes are formed for allowing the circulation of air between the case and the fan, thereby carrying perfume from a perfume pocket put into a space in the case to a user by the air movement caused during the rotation of the fan.

A fifth example, U.S. Pat. No. 6,192,702 B1 to Shimagori teaches a personal cooling device that may be slung about the neck of a wearer for providing personal cooling under various conditions and wherein the device may be stowed about the waistband of a garment of the user of the device when not used for cooling purposes.

SUMMARY OF THE INVENTION

An object of the present invention is to provide a neck fan for personal cooling that avoids the disadvantages of the prior art.

Another object of the present invention is to provide a neck fan for personal cooling that is simple and inexpensive to manufacture.

Still another object of the present invention is to provide a neck fan for personal cooling that is simple to use.

Briefly stated, still yet another object of the present invention is to provide a neck fan for personal cooling which can be supported by a lanyard around a wearer's neck so that a cooling breeze may be directed to cool the wearer's face and neck area while the wearer's hands are free to be engaged in ordinary activities of work, leisure, play, etcetera.

The geometry of the construction of the fan device of the present invention is such that it lay close to the body of the wearer so as to minimize the fan device from coming into undesirable contact with other items in the wearer's environment.

The lanyard which supports the fan device about the wearer's neck is provisioned to allow the fan device to be adjusted so as to hang at a correct height, and an optimum angle so as to keep the wearer comfortable and efficiently cooled. The lanyard also may be provisioned with an optional break-away safety link so that should the fan device become accidentally entangled or pulled with sufficient force by items in the environment the break-away safety link will permit the lanyard to separate before the wearer will be choked, strangled, or otherwise seriously injured.

The novel features which are considered characteristic of the present invention are set forth in the appended claims.

The invention itself, however, both so to its construction and its method of operation, together with additional objects and advantages thereof, will be best understood from the following description of the specific embodiments when read and understood in connection with the accompanying drawings.

BRIEF DESCRIPTION OF THE DRAWINGS

The figures of the drawings are briefly described as follows.

A MARSHALLING OF REFERENCE NUMERALS UTILIZED IN THE DRAWING

Figure 1:
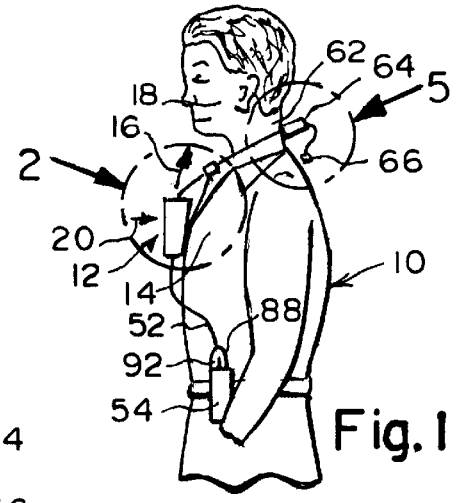
FIG. 1 is a side elevational view of a person wearing the present invention.

10 wearer utilizing the fan device 12
12 fan device of the present invention
14 wearer's chest area
16 air flowing breeze to be angled at the face and neck
18 face and neck area of the wearer
20 arrow indicating intake air
22 protective grill
24 front face
26 rear baffle
28 electric fan component
30 open upper output air exit area
32 square face
34 left hand trapezoidal side
36 right hand trapezoidal side
38 bottom rectangular surface
40 axis of rotation
42 curve portion cut away from an upper edge 44 of electric fan component 28
44 upper rear edge of electric fan component 28
46 blades
48 center hub
50 circular venturi
52 electrical power cord assembly
54 battery pack
56 corner of a rear upper edge 44 of the electric fan component
58 corner of a rear upper edge 44 of the electric fan component
60 supporting main lanyard component
62 wearer's neck
64 frictional sliding length adjustment component
66 break-away safety link
68 two identical supplemental angle adjusting lanyard components
70 first ends of identical supplemental adjusting lanyard components
72 bottom corner edge of the prismatic shape housing 82
74 second ends of identical supplemental adjusting lanyard components
76 pair of sliding frictional adjustment blocks
78 directional movement arrow
80 directional movement arrow
82 prismatic shape housing
84 both ends of a supporting main lanyard component 60
86 point approximately equidistant from both ends 84 of a supporting main lanyard component 60
88 plug
92 optional on—off power switch
94 surface oriented at an acute angle 96 with respect to an axis of rotation 40
96 acute angle
98 corner edge
99 corner edge

DETAILED DESCRIPTION OF THE PREFERRED EMBODIMENT

Referring now to the figures, in which like numerals indicate like parts, and particularly to FIG. 1, shows a wearer 10 utilizing the fan device 12 of the present invention which is resting upon a wearer's chest area 14 and accordingly causes an air flowing breeze 16 to be angled at the face and neck area 18 of the wearer.

Figure 2:
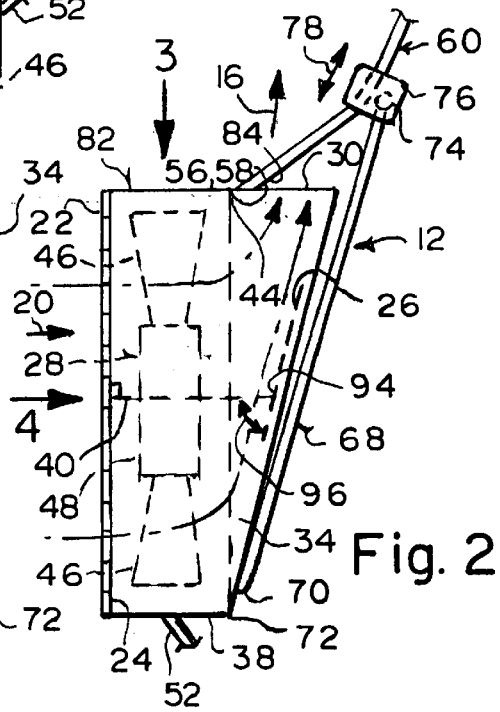
FIG. 2 is an enlarged side elevational view of the portion of the present invention enclosed in the dotted curve indicated by arrow 2 in FIG. 1.

FIG. 2 shows an enlarged side elevational view of the portion of the present invention enclosed in the dotted curve indicated by arrow 2 in FIG. 1 in greater detail. It will be observed that intake air, indicated by arrow 20, is drawn in through a protective grill 22 attached to a front face 24, best seen in FIG. 4, of an electric fan component 28 of the fan device 12. Accordingly because of the geometry of a prismatic shaped housing 82, in which the electric fan component 28 is mounted, the intake air is caused to change direction approximately by 90 degrees, by a rear baffle 26 and exit from an open upper air exit area 30 thereof, as indicated by arrow 16. This geometry permits the fan device 12 to have a relatively thin profile compared to devices of other prior art, and accordingly allows the device to lay close to a wearer's chest area 14 without projecting very far therefrom.

Figure 3:
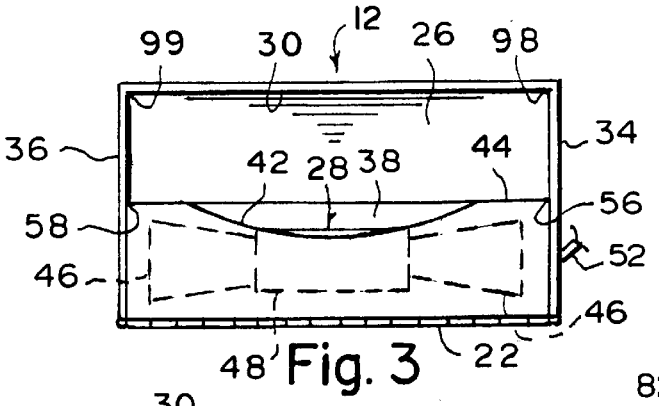
FIG. 3 is a top elevational view, with parts broken away, taken in the direction of arrow 3 in FIG. 2.
Figure 4:
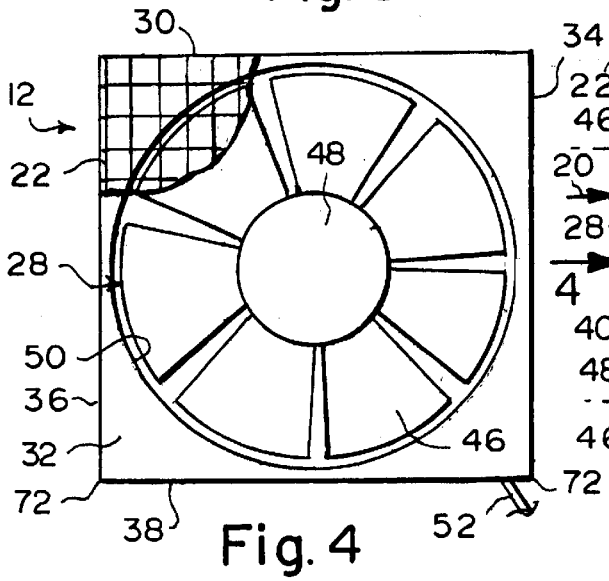
FIG. 4 is a front elevational view taken in the direction of arrow 4 in FIG. 2.

The fan device 12, when viewed from a front direction, i.e. in the direction of arrow 4, is illustrated typically as square face 32, has the protective grill 22, as best seen in FIG. 4, joined by two trapezoidal sides, i.e., a left hand trapezoidal side 34, a right hand trapezoidal side 36, as best seen in FIG. 2, which are further joined by a back baffle 26, at corner edges 98, 99 and 72 respectively, which has a surface 94 oriented at an acute angle 96 with respect to an axis of rotation 40 of said electric fan component 28, and a bottom rectangular surface 38 well seen in FIGS. 2, 3 and 4, so as to generally form the prismatic shaped housing 82.

Electric fan component 28 of the fan device 12, having a center hub 48, having at least two blades, but illustrated typically with seven blades 46, is centrally mounted within the prismatic shaped housing 82 with its axis rotation 40 perpendicular to the square face 32, and grill 22, so that air 20 drawn in through a circular venturi 50, behind protective grill 22, mostly torn away for clarity exits an open upper air exit area 30. A curved portion 42 is cut away from an upper rear edge 44 of electric fan component 28 so as to enlarge an exit of the open upper air exit area 30.

An electric power cord assembly 52 communicates with a battery pack 54, worn by the wearer 10, or carried in a clothing pocket not shown, so as to supply the energy for rotating the electric fan component 28. A plug 88 and optional on-off power switch 92 may be incorporated in the electrical power cord assembly 52 as well known by those in the art.

Figure 5:
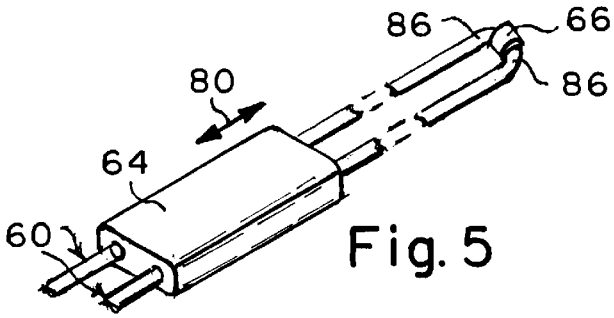
FIG. 5 is an enlarged perspective view of a portion of the support lanyard of the present invention enclosed in the dotted curve indicated by arrow 5 in FIG. 1.

Both ends 84, of a supporting main lanyard component 60 are suitably attached at two places to the prismatic shaped housing, near corners 56 and 58 of a rear upper edge 44 of the electric fan component 28, for encirclement of the wearer's neck 62. As best seen in FIG. 5, a frictional sliding length adjustment component 64, which frictionally engages the supporting main lanyard component 60, is provided and may accordingly be slid, as indicated by directional movement arrow 80, along the supporting main lanyard component 60 so as to adjust the effective length of the lanyard, which supports the fan device 12 at a comfortable height upon the wearer's chest area 14. A break-away safety link 66 is suitably attached at a point 86 approximately equidistant from both ends 84 of a supporting main lanyard component 60, which will either fracture or otherwise permit the supporting main lanyard component 60 to separate at point 86, before the wearer will be choked or strangled should the fan device 12 become entangled or pulled with sufficient force by items in the environment and accordingly prevent inadvertent accidental injuries to the wearer 10.

Two identical supplemental angle adjusting lanyard components 68 have their first ends 70, suitably attached near the bottom corner edge 72 of the prismatic shaped housing 82 of fan device 12, and their second ends 74 embedded in a pair of sliding frictional adjustment blocks 76, which frictionally engage the supporting main lanyard component 60, close to where they are attached at two places to the electric fan component 28, near corners 56 and 58 of a near upper edge 44 of the electric fan component 28, so as to permit adjustment of the angle at which air is accordingly discharged at the wearer's face and neck area, by positioning the sliding frictional adjustment blocks 76 along the length of the supporting main lanyard component 60, as indicated by directional movement arrow 78, which accordingly causes the fan device 12 to tilt at a variety of different angular positions upon the wearer's chest area 14.

It will be understood that each of the elements described above, or two or more together, may also find a useful application in other types of constructions differing from the types described above.

While the invention has been illustrated and described as embodiments of a neck fan for personal cooling, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A hands-free fan device for cooling a wearer's neck and face area, comprising:

a) an electric fan component for causing an air output;

b) a housing means for within mounting the electric fan component;

c) a geometric means for causing all intake air to change direction approximately by 90 degrees and exit as the output air in an upward direction toward the face area; and d) means for supporting said housing means upon the wearer's chest area.

2. The hands-free fan device as defined in claim 1, wherein said geometric means for causing all intake air to change direction approximately by 90 degrees and exit as the output air, is a back baffle, which is enclosed on all sides other than an open upper air exit area.

3. The hands-free fan device as defined in claim 2, wherein said open upper air exit area has a curved portion out away from a rear edge of the electric fan component, so as to enlarge an exit of the open upper air exit area.

4. The hands-free fan device as defined in claim 1, wherein said means for supporting said housing means upon the wearer's chest area comprising:

a) a supporting main lanyard component for encircling the wearer's neck, wherein both ends of said supporting main lanyard component are suitably attached at two places to the electric fan component; and b) a frictional sliding adjustment component, which frictionally engages the supporting main lanyard component, so as to permit adjustment of an effective length of the supporting main lanyard component which supports the fan device.

5. The hands-free fan device as defined in claim 4, wherein said means for supporting said housing means upon the wearer's chest area further comprises: two identical supplemental adjusting lanyard components having their first ends suitably attached near a bottom corner edge of the prismatic shaped housing of the fan device, and their second ends embedded in a pair of sliding frictional adjustment blocks, which frictionally engage the supporting main lanyard component, so as to permit adjustment of the angle at which air is accordingly discharged at the wearer's face and neck area, by positioning the sliding frictional adjustment blocks along the length of the supporting main lanyard component, and accordingly cause the fan device to tilt at a variety of different angular positions upon the wearer's chest area.

6. The hands-free fan device as defined in claim 4, wherein said means for supporting said housing means upon the wearer's chest area further comprises: a break-away safety link, which will fracture, should the fan device become entangled or pulled with sufficient force by items in the environment and accordingly prevent inadvertent accidental injuries to the wearer.

7. The hands-free fan device as defined in claim 1, wherein said electric fan component for causing an air output has an electrical power cord, a plug, and an on-off power switch, for communicating with a battery pack.

8. The hands-free fan device as defined in claim 1, wherein said electric fan component for causing an air output has a center hub having at least two blades.

* * * * *